United States Patent [19]

Panissidi et al.

[11] 4,211,147

[45] Jul. 8, 1980

[54] SERVO-CONTROL VALVE FOR A LINEAR HYDRAULIC MOTOR

[75] Inventors: Hugo A. Panissidi, Peekskill; Glenmore L. Shelton, Jr., Carmel, both of N.Y.; Peter M. Will, Norwalk, Conn.

[73] Assignee: International Business Machines Corporation, Armonk, N.Y.

[21] Appl. No.: 811,760

[22] Filed: Jun. 30, 1977

[51] Int. Cl.[2] ..... F15B 13/02

[52] U.S. Cl. ..... 91/184; 137/595; 137/624.18; 251/213

[58] Field of Search ..... 91/183, 184; 308/6 B; 137/624.18, 624.2, 595, 630.2; 251/213

[56] References Cited

U.S. PATENT DOCUMENTS 3,271,087 9/1966 Wieland et al. ..... 308/6 B 3,848,515 11/1974 Gardineer et al. ..... 91/184

FOREIGN PATENT DOCUMENTS 1398012 6/1975 United Kingdom ..... 91/183

*Primary Examiner*—Gerald A. Michalsky

*Attorney, Agent, or Firm*—Philip Young

[57] ABSTRACT

A servo-control valve for a linear hydraulic motor wherein the control valve piston is isolated from the side loading of a cam and roller by employing a cam follower plunger, as a separate detached element coaxial with the piston. The valve piston and the cam follower plunger are maintained in intimate contact due to the constant back pressure applied by the hydraulic system. The plunger is encased in a cylindrical array of balls which are preloaded between the plunger and the piston chamber walls such that the plunger experiences essentially only rolling friction, but no sliding friction, as the plunger moves. This form of preloading of the balls eliminates the backlash associated with clearance around the plunger.

4 Claims, 3 Drawing Figures

SERVO-CONTROL VALVE FOR A LINEAR HYDRAULIC MOTOR

BACKGROUND OF THE INVENTION

The present invention relates to hydraulic drive systems, and more particularly to a servo-control valve for a hydrostatic motor.

Linear hydraulic drive systems supply three orthogonal motions in programmable manipulators such as that described in U.S. Pat. No. 4,001,556 to Folchi et al. These drive systems permit the gripper assembly to be positioned at any desired location within a prescribed area. Since the loads exerted on the x, y and z axes can vary considerably, a constant force produces different accelerations on the axes. Therefore, precise trajectory control requires compensation for this variability. Both accuracy specifications and the desired dynamic characteristics make it necessary that stringent requirements be placed on the critical design parameters for these axes. The most significant of these parameters are friction, hysteresis, stiffness, and constant force. Each of these, either independently or jointly, dominate the sensitivity of small motion requirements, repeatibility, frequency response and overall performance which is independent of position.

In the linear hydraulic drive system disclosed in U.S. Pat. No. 3,848,515 to Gardineer et al, each manipulator axis arm is an integral part of the linear hydraulic drive assembly. A linear drive cam is mounted to the manipulator arm with its amplitude describing a parabolic function. A cylinder block mounted to the supporting joint for the arm contains four drive pistons centers which ride on the surface of the drive cam through rollers. The drive pistons impart an axial thrust to the drive cam which is attached to and extends along the arm, provided the hydraulic pressure is correctly commutated to each of the pistons. The axial thrust is converted into linear motion by the angle of the cam.

In such patent there is described the possibility of providing extremely close operating tolerances in the linear hydraulic motor wherein pressure is continuously maintained on the system during all controlled modes of operation, whether in a dynamic or rest state. In the rest state, pressure is maintained on all of the plurality of actuating pistons and when movement is required the pressure is released on all but the desired piston or pistons which must produce the linear displacement between the motor and the associated linear cam. By suitable mounting the actuating cam on the lever arm rack, a rotational torque is maintained relative to the main motor body carrying the actuating pistons and the rack whereby the two are rotationally locked in a fixed position capable of withstanding very substantial deflecting forces. Further, the structure automatically compensates for wear in any of the bearing surfaces which support the cam carrying linear arm.

In some known hydraulic motors, the piston, or a piston valve member, is spring loaded to maintain the valve members in coupled relation or to maintain a certain pressure on the piston. One example is the rotary hydraulic motor disclosed in U.S. Pat. No. 3,583,286 to Chiappulini wherein a spherical ball joint between the piston-valve and the cam follower is employed together with a spring loading on the piston valve. If the springs follow Hooke's Law, the net spring forces on the system would be a function of positioning and, consequently, the constant force nature of the motor could be altered.

Also, in some known hydraulic motors, ball bearings operating in sockets, or rollers operating in grooves are employed to prevent side loading of the piston with its associated high friction. Such systems introduce both rolling friction and sliding friction into the piston movement. This is undesirable, particularly in low speed operations where minimum friction is required.

SUMMARY OF THE INVENTION

It is an object of the present invention to provide a linear hydraulic motor having minimum side loading, friction and backlash associated with piston operation.

It is another object to provide a linear hydraulic motor with constant back pressure on the hydraulic operation.

These and other objects are achieved by the present invention which provides a servo-control valve for a linear hydraulic motor wherein the control valve piston is isolated from the side loading of a cam and roller by employing a cam follower plunger as a separate detached element coaxial with the piston. In one embodiment, a set of four drive pistons can be employed to impart through their respective cam follower plungers, an axial thrust to the surface of a linear drive cam through rollers operating on the cam surface which describes a parabolic function. The valve piston and the cam follower plunger are maintained in intimate contact by means of the constant hydraulic back pressure applied by the system.

The plunger is encased in a cylindrical array of ball bearings which are preloaded between the plunger and the piston chamber walls such that essentially only a rolling action occurs as the plunger operates in the chamber. The balls are spaced apart by means of a cylindrical cage having a plurality of holes through which the balls extend as they are pressed between the plunger and piston chamber walls. In this fashion, the plunger experiences only a rolling friction, but no sliding friction, as the plunger moves. This form of preloading of the balls eliminates the backlash otherwise associated with clearance around the plunger.

DESCRIPTION OF THE PREFERRED EMBODIMENTS

Figure 1:
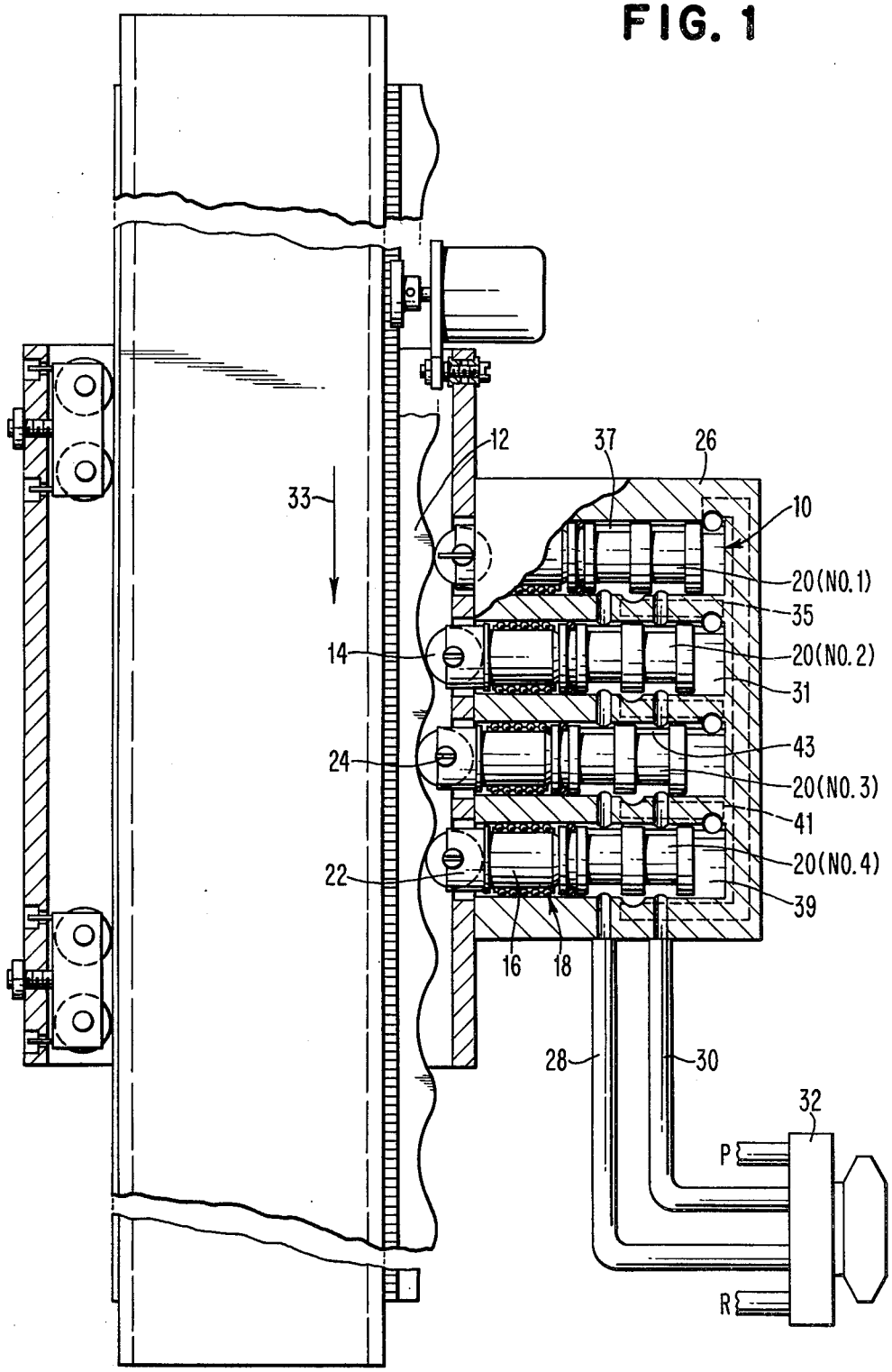
FIG. 1 is a partial sectional view of a linear hydraulic motor employing four servo control valves, illustrative of the present invention, for operating a linear drive cam mounted on the arm of a manipulator device.

Referring to FIG. 1, there is shown the servo-control valve employed in a four piston linear hydraulic motor for driving a linear cam mounted on the arm of a manipulator device. Specifically, each of four servo-control valves 10 form a piston of the linear motor drive assembly for driving a linear drive cam 12 having a parabolic function via cam follower rollers 14 that receive an axial pressure from a cam follower plunger 16. A piston spool valve 20 is driven by the plunger type follower 16 that is encased in a caged linear ball bearing arrangement 18. A yoke 22 at the end of the plunger 16 supports the cam follower roller bearing 14 having a spherical outer diameter to minimize skewing. One end of the shaft of the roller follower 14 is slotted to accept a guide pin 24 pressed into the cylinder block 26 to prevent the plunger 16 from rotating about its axis. The piston spool valve 10 is always in contact with its plunger type follower 16 since the hydraulic pressure driving it is always positive in the normal operation of the linear motor assembly.

Hydraulic channels 28 and 30 are common to all four pistons and their connection to the top of the drive pistons is determined by the position of the center land of the piston valve to which it is connected. For purposes of this description, the four piston valves 20 will be referred to as pistons #1, #2, #3 and #4, respectively, as shown. To illustrate the hydraulic operation of the drive pistons by the hydraulic channels 28 and 30, if the hydraulic channel 28 is connected to pressure P from a servo valve 32 and the channel 30 is connected to the reservoir R, then chamber 31 at the top of piston #2 is connected to pressure P via channel 35, groove 37 and channel 28. Also, the chamber 39 at the top of piston #4 will be connected to the reservoir R via channel 41, groove 43 and channel 30. The pressure P and reservoir R are provided through the servo valve 32.

The direction of the slope of the drive cam 12 in contact with the downward thrust of piston #2 will cause the arm to move downward in the direction of arrow 33 in the FIG. 1 configuration. The pressure conditions at the top of the pistons #1 and #3 contribute nothing to the manipulator arm movement since they are at top and bottom dead center of the drive cam during this instant of the motor cycle.

Figure 2:
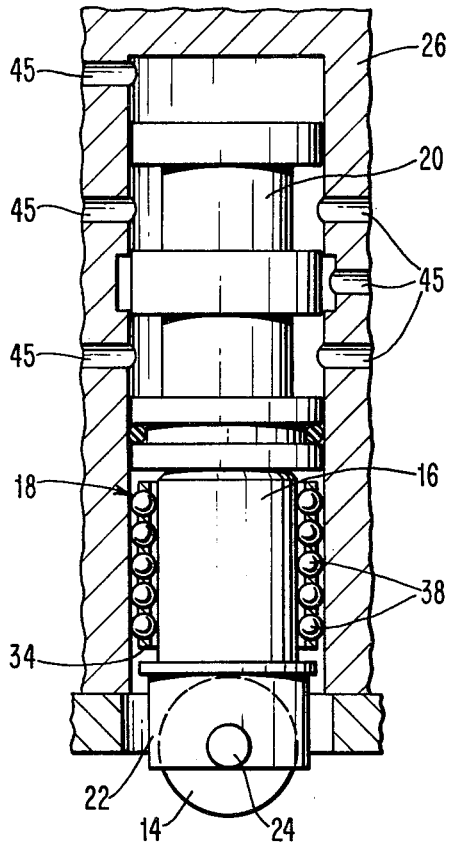
FIG. 2 is a partial sectional view of the servo control valve shown in FIG. 1 illustrating in more detail the plunger, piston and ball bearing arrangement.

The cam follower plunger design shown in FIG. 2 is designed to minimize the friction resulting from the heavy side loading of the drive pistons. The piston valve 20 includes conventional lands and undercuts to commutate fluid to adjacent piston valves via its ports 45.

Thus, the cam follower 16 and the piston valve can be seen to be fully decoupled while being maintained in intimate contact by means of the hydraulic system back pressure which remains constant when the hydraulic system is on. Also, the cylindrical linear bearing assembly 18 is preloaded with the cam follower plunger 16 to thereby minimize friction due to side loading of the plunger 16 and eliminating any backlash of the cam follower.

Figure 3:
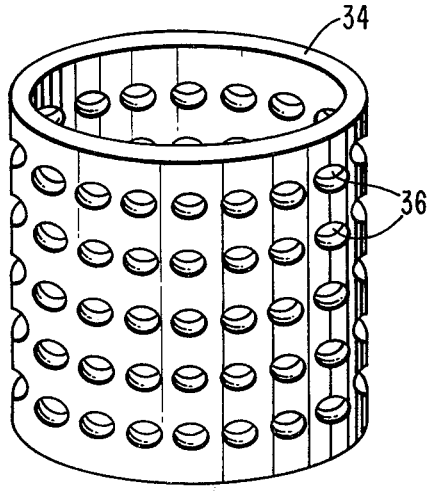
FIG. 3 shows a cylindrical cage for retaining the preloaded balls in spaced apart relation around the plunger.

FIG. 3 shows the linear bearing arrangement 18 in greater detail wherein a hollow cylinder 34 has a plurality of spaced apart holes 36 into which a plurality of ball bearings 38 are caged. The cylinder 34 merely maintains the balls 38 is spaced apart relation and does not provide any grooves for encasing the ball. In this fashion, the balls 38 are free to purely roll between the plunger 16 and the cylinder block walls as the piston valve 20 is activated. This arrangement avoids the backlash and higher friction associated with other roller groove and encased ball bearing arrangements.

While the invention has been particularly shown and described will reference to preferred embodiments thereof, it will be understood by those skilled in the art that the foregoing and other changes in form and details may be made therein without departing from the spirit and scope of the invention.

What is claimed is:

1. A servo-control valve for a linear hydraulic motor that drives a linear cam, comprising:

a hydraulically actuated control valve piston contained in a motor cylinder block, each said control valve piston having a groove which is in fluid communication with a source of fluid pressure for driving said piston;

a cylindrical cam follower plunger interposed in axial alignment between said valve piston and a linear cam, said cam follower plunger not being attached to said valve piston but being maintained in linear contact with said valve piston by means of hydraulic back pressure on the control valve piston, said cam follower plunger including a cam follower roller bearing being supported by a yoke at one end of said plunger for engagement with said linear cam, said yoke supporting said cam follower roller bearing by means of a guide pin providing its shaft axis and serving to prevent the cylindrical plunger from rotative movement; and ball bearing means preloaded between said cam follower plunger and said motor cylinder block such that said ball bearing means experience only a rolling friction.

2. Apparatus as recited in claim 1, wherein said ball bearing means includes a hollow cylinder encircling said cam follower plunger, said cylinder having a plurality of spaced apart holes into which respective ones of a plurality of hard balls are caged, and said balls having a larger diameter than the thickness of the wall of said hollow cylinder so that said balls roll with the relative movement between said cam follower plunger and said motor cylinder block.

3. A servo-control valve for a linear hydraulic motor, comprising:

a control valve piston contained in a chamber in a motor cylinder block, each said control valve piston having a groove which is in fluid communication with a source of fluid pressure for driving said piston;

a cylindrical cam follower plunger adjacent said control valve piston and in axial alignment therewith, said cam follower plunger being maintained in intimate contact with said control valve piston due to hydraulic back pressure on said control valve piston; said cam follower plunger including a cam follower roller bearing being supported by a yoke at one end of said plunger for engagement with said linear cam, said yoke supporting said cam follower roller bearing by means of a guide pin providing its shaft axis and serving to prevent the cylindrical plunger from rotative movement; and ball bearing means disposed in a preload relationship between said cam follower plunger and a wall of the chamber in said motor cylinder block, said ball bearing means including a cylindrical array of balls spaced apart around said plunger by a cylindrical cage having holes through which each ball is disposed, said balls contacting both said cam follower plunger and said chamber wall as it is pressed therebetween, whereby said balls undergo essentially rolling friction as the plunger moves.

4. A linear hydraulic motor having a servo-control valve, comprising:

a motor block containing a plurality of hydraulically actuated control valve pistons, said valve pistons having grooves which are connected to hydraulic pressure supply means to sequentially operate said pistons for effecting relative movement between said motor block and a linear cam drive rack selectively in either direction;

a cylindrical cam follower plunger interposed in axial alignment between each said valve piston and said linear cam drive rack, said cam follower plunger being maintained in linear contact with said valve piston by means of hydraulic back pressure on each of said control valve pistons; said cam follower plunger including a cam follower roller bearing being supported by a yoke at one end of said plunger for engagement with said linear cam, said yoke supporting said cam follower roller bearing by means of a guide pin providing its shaft axis and serving to prevent the cylindrical plunger from rotative movement; and ball bearing means preloaded between said cam follower plunger and said motor cylinder block such that said ball bearing means experience only a rolling friction;

whereby the pressure of said cam follower plunger causes a torsional force to be applied to said linear cam drive rack.

* * * * *